United States Patent [19]

Maa et al.

[11] 4,283,267

[45] Aug. 11, 1981

[54] STAGED TEMPERATURE HYDROGEN-DONOR COAL LIQUEFACTION PROCESS

[75] Inventors: Peter S. Maa; Lonnie W. Vernon, both of Baytown, Tex.

[73] Assignee: Exxon Research & Engineering Co., Florham Park, N.J.

[21] Appl. No.: 904,826

[22] Filed: May 11, 1978

[51] Int. Cl.[3] ..... C10G 1/00; C10G 1/06

[52] U.S. Cl. ..... 208/8 LE; 208/10

[58] Field of Search ..... 208/18 LE, 10

[56] References Cited

U.S. PATENT DOCUMENTS

| | | | |
|---|---|---|---|
| 3,143,489 | 8/1964 | Gorin | 208/10 |
| 3,355,376 | 11/1967 | Gorin et al. | 208/10 |
| 3,488,279 | 1/1970 | Schulman | 208/8 LE |
| 3,594,305 | 7/1971 | Kirk, Jr. | 208/10 |
| 3,679,573 | 7/1972 | Johanson | 208/10 |
| 3,692,662 | 9/1972 | Wilson et al. | 208/8 |
| 3,700,584 | 10/1972 | Johanson et al. | 208/10 |
| 3,791,957 | 2/1974 | Wolk | 208/10 |

FOREIGN PATENT DOCUMENTS

| | | |
|---|---|---|
| 293808 | 1/1930 | United Kingdom . |
| 492551 | 9/1938 | United Kingdom . |
| 779901 | 7/1957 | United Kingdom . |

*Primary Examiner*—Delbert E. Gantz
*Assistant Examiner*—William G. Wright
*Attorney, Agent, or Firm*—Yale S. Finkle

[57] ABSTRACT

An increased yield of hydrogenated liquid product is obtained from coal by contacting the feed coal with a hydrogen-donor solvent and a hydrogen-containing gas in a series of two or more liquefaction zones arranged in series and operated in such a manner that the temperature in each zone increases from the initial to the final zone. The effluent from each liquefaction zone is passed to the next succeeding higher temperature zone in the series. Liquid hydrocarbonaceous products are recovered from the effluent withdrawn from the last zone. Hydrogen-donor solvent may be produced in the process by catalytically hydrogenating at least a portion of the liquid product from the last liquefaction zone, recovering a liquid fraction from the product of the catalytic hydrogenation and separating a hydrogen-donor solvent from the liquid fraction.

12 Claims, 1 Drawing Figure

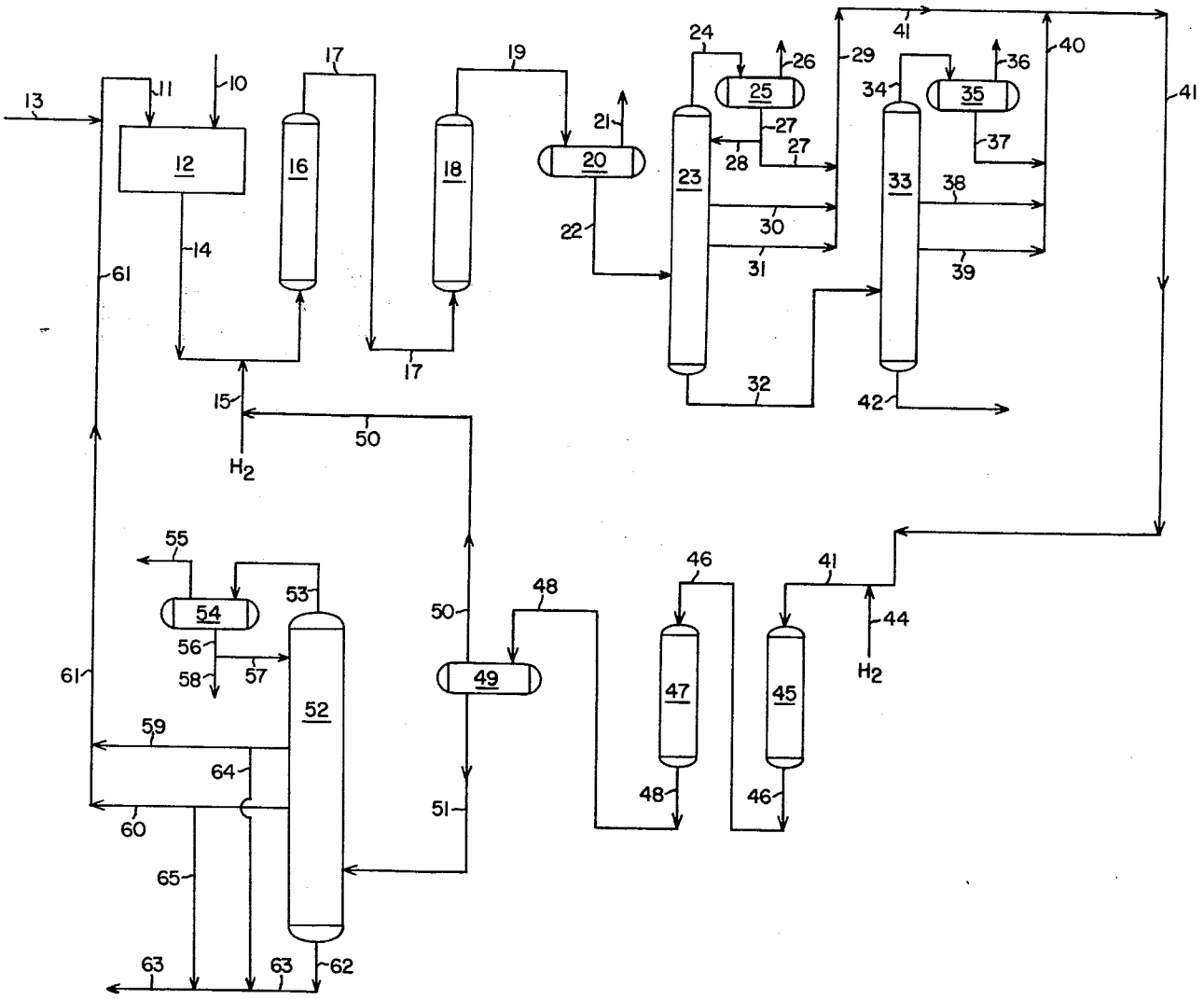
10
11
12
13
14
15
16
17
18
19
20
21
22
23
24
25
26
27
28
29
30
31
32
33
34
35
36
37
38
39
40
41
42
44
45
46
47
48
49
50
51
52
53
54
55
56
57
58
59
60
61
62
63
64
65
H2
H2

STAGED TEMPERATURE HYDROGEN-DONOR COAL LIQUEFACTION PROCESS

BACKGROUND OF THE INVENTION

1. Field of the Invention

This invention relates to coal liquefaction and is particularly concerned with staged temperature hydrogen-donor coal liquefaction.

2. Description of the Prior Art

A number of different processes are being developed for the production of liquid hydrocarbons from coal. Among the most promising of these are processes in which the feed coal is first contacted with a hydrogen-containing gas and a hydrogen-donor solvent at elevated temperature and pressure in a liquefaction reactor and a portion of the liquid product is then catalytically hydrogenated in a solvent hydrogenation reactor to generate a hydrogen-donor solvent for recycle to the liquefaction step. Within the liquefaction zone, the high molecular weight constituents of the coal are cracked and hydrogenated to form lower molecular weight vapor and liquid products. The effluent from the liquefaction reactor is then separated into gases, low molecular weight liquids, and a bottoms stream containing high molecular weight constituents and unconverted mineral matter. The separation of the liquefaction reactor effluent is normally made in such a manner as to produce a bottoms stream consisting of material that boils above about 1000° F. The bottoms stream is composed primarily of high molecular weight hydrocarbons formed when the original high molecular weight coal constituents are only partially converted in the liquefaction reactor, suspended particles of unreacted coal, mineral matter and other solid residues. Depending on liquefaction conditions, the bottoms stream will normally contain from about 40 to 60 wt.% of the high molecular weight hydrocarbons and unconverted coal based on the weight of the original dry coal feed.

It has been suggested that the quantity of high molecular weight bottoms formed from a caking type coal in the above process or similar one-stage liquefaction processes can be decreased and coal conversion therefore increased by utilizing a pretreatment step in which the caking coal is completely dispersed in the hydrogen-donor solvent before the slurry is subjected to liquefaction conditions. Complete dispersion is obtained by maintaining the coal-solvent slurry at a temperature within the range from about 500° F. to about 700° F. as it is agitated. Normally, complete dispersion is indicated when the viscosity of the slurry passes through a maximum and then falls to a value within a predetermined range lower than the maximum. In the agitated pretreatment step an insignificant number of coal molecule bonds are broken and therefore little if any liquefaction actually occurs. The pretreatment step is utilized to obtain a complete dispersion of the coal in the solvent so that the coal particles will be in intimate contact with the hydrogen-donor solvent during the subsequent liquefaction step, and therefore the coal radicals produced in that step can be more effectively stabilized to prevent their recombination. This in turn results in an increased production of low molecular weight liquids.

Although the above-described process supposedly has advantages over other processes for liquefying coals, it has disadvantages in that it is applicable only to the liquefaction of caking type coals, and agitation is required during the pretreatment step. Furthermore, virtually no liquefaction takes place in the pretreatment step.

SUMMARY OF THE INVENTION

The present invention provides an improved process for converting coal or similar liquefiable carbonaceous solids into lower molecular weight liquid hydrocarbons that at least in part alleviates the difficulties described above. In accordance with the invention, it has now been found that an increased yield of hydrogenated liquid products is obtained from bituminous coal, subbituminous coal, lignite or a similar carbonaceous feed material by contacting the feed solids with a hydrogen-donor solvent under liquefaction conditions in a plurality of liquefaction zones arranged in series and operated such that the temperature in each zone increases from the initial to the final zone of the series. The effluent from each liquefaction zone excluding the final zone is passed to the next succeeding zone of higher temperature. In this manner the feed solids that are not liquified or converted into lower molecular weight liquids in the initial zone are at least partially liquified in the second zone, the unconverted solids in the effluent from the second zone are at least partially liquified in the third zone and so forth until the final zone is reached. Here the remaining unconverted solids are subjected to a relatively high temperature, preferably greater than about 760° F., for maximum conversion of solids into lower molecular weight liquids. The effluent from the last liquefaction zone is then treated to recover liquid hydrocarbonaceous products. The liquefaction that takes place in each zone may be carried out in the presence or absence of an added hydrogenation or hydrogen transfer catalyst. Studies indicate in general that the total residence time for all of the liquefaction zones combined, excluding the final zone should normally be above about 65 minutes, preferably between about 85 and 150 minutes, to significantly increase the amount of liquid yield over that of a single stage liquefaction. The temperature in the initial zone should normally be at least about 670°, preferably between about 690° F. and about 730° F.

It is preferred that the liquefaction occurring in each zone of the series be carried out in the presence of a hydrogen-containing gas, preferably molecular hydrogen. In some cases, however, it may be desirable that the hydrogen-containing gas be present only in the latter zones and not in the initial zone or zones of the series. It is also preferred that the hydrogen-donor solvent be produced in the process by catalytically hydrogenating at least a portion of the liquid product from the final zone, recovering a liquid fraction from the products of the catalytic hydrogenation and separating the hydrogen-donor solvent from the liquid fraction.

As many liquefaction zones as are economically viable may be utilized. In the preferred embodiment of the invention, only two zones are utilized. The carbonaceous feed solids are contacted with a hdrogen-donor solvent and molecular hydrogen under liquefaction conditions in the first liquefaction zone which is normally maintained at a temperature between about 670° F. and about 740° F. and operated to have a residence time above about 65 minutes. The effluent from the first zone is subsequently subjected to liquefaction conditions in the second liquefaction zone maintained at a temperature greater than the temperature in the first liquefaction zone to liquify or convert the unconverted solids or high molecular weight constituents in the first liquefaction zone effluent into lower molecular weight liquids. Preferably, the temperature in the second zone is between about 100° F. and 150° F. greater than the temperature in the first zone. A liquid hydrocarbonaceous product is then recovered from the effluent of the second zone. The residence time utilized in the first liquefaction zone will normally be sufficient to produce a significant increase in liquids production in the two stage system over that obtainable for a single stage liquefaction at the conditions existing in the second or final stage liquefaction zone.

The process of the invention results in a substantial increase in the amount of coal converted into lower molecular weight liquids and therefore has definite advantages over other hydrogen-donor solvent liquefaction processes.

BRIEF DESCRIPTION OF THE DRAWING

The drawing is a schematic diagram of a staged temperature hydrogen-donor liquefaction process for producing liquid products from coal carried out in accordance with the invention.

DESCRIPTION OF THE PREFERRED EMBODIMENTS

In the process depicted in the drawing, feed coal or similar carbonaceous material is introduced into the system through line 10 from a coal storage or feed preparation zone not shown in the drawing, and combined with a hydrogen-donor solvent introduced through line 11 to form a slurry in slurry preparation zone 12. The feed coal employed will normally consist of solid particles of bituminous coal, subbituminous coal, lignite, brown coal, or a mixture of two or more such materials. In lieu of coal, other carbonaceous solids may be introduced into the slurry preparation zone. Such materials include organic wastes, oil shale, and the like. The particle size of the feed material may be on the order of about a quarter inch or larger along the major dimension but will preferably be crushed and screened to a particle size of about 8 mesh or smaller on the U.S. Sieve Series Scale. It is generally preferred to dry the feed particles to remove excess water, either by conventional techniques before the solids are mixed with the solvent in the slurry preparation zone or by mixing the wet solids with hot solvent at a temperature above the boiling point of water, preferably between about 250° F. and 350° F. to vaporize the water in the preparation zone. The moisture in the feed slurry is preferably reduced to less than about 2 weight percent.

The hydrogen-donor solvent used in preparing the coal-solvent slurry will normally be a coal-derived solvent, preferably a hydrogenated recycle solvent containing at least 20 weight percent of compounds that are recognized as hydrogen donors at the elevated temperatures of about 650° F. to about 1000° F. generally employed in coal liquefaction reactors. Solvents containing at least 50 weight percent of such compounds are preferred. Representative compounds of this type include $C_{10}$–$C_{12}$ tetrahydronapthalenes, $C_{12}$ and $C_{13}$ acenapthenes, di-, tetra- and octahydroanthracenes, tetrahydroacenaphthenes and other derivatives of partially hydrogenated aromatic compounds. Such solvents have been described in the literature and will therefore be familiar to those skilled in the art. The solvent composition resulting from the hydrogenation of a recycle solvent fraction will depend in part upon the particular coal used as the feedstock to the process, the process steps and operating conditions employed and the conditions used in hydrogenating the solvent fraction selected for recycle following liquefaction. In slurry preparation zone 12 the incoming feed coal is normally mixed with solvent recycled through line 11 in a solvent-to-coal weight ratio of about 1.0:1 to about 5.0:1, preferably from about 1.0:1 to about 3.0:1. The solvent employed in initial startup of the process and any makeup solvent required can be added to the system through line 13.

The coal-solvent slurry prepared as described above is withdrawn from slurry preparation zone 12 through line 14; mixed with a hydrogen-containing gas, preferably molecular hydrogen, injected into line 14 via line 15, preheated to a temperature above about 670° F.; and injected into first stage liquefaction reactor 16. The mixture of the slurry and hydrogen-containing gas will contain from about 1 to about 8 weight percent, preferably from about 2 to about 5 weight percent, of hydrogen on a moisture and ash free coal basis. The liquefaction reactor is maintained at a temperature between about 670° F. and about 740° F., preferably between about 690° F. and about 730° F., and at a pressure between about 300 psig and about 4500 psig, preferably between about 1000 psig and about 2500 psig. Although a single liquefaction reactor is shown in the drawing as comprising the first stage, a plurality of reactors arranged in parallel or series can also be used, providing that the temperature and pressure in each reactor remain approximately the same. Such will be the case if it is desirable to approximate a plug flow situation. The slurry residence time within first stage reactor 16 will normally be above about 65 minutes and will preferably range from about 85 minutes to about 150 minutes. A residence time of about 120 minutes appears to be most preferable.

Within the liquefaction zone, the coal undergoes liquefaction or chemical conversion into lower molecular weight constituents. The high molecular weight constituents of the coal are broken down and hydrogenated to form lower molecular weight gases and liquids. The hydrogen-donor solvent gives up hydrogen atoms that react with organic radicals liberated from the coal to stabilize them and thereby prevent their recombination. The hydrogen injected into line 14 via line 15 also serves at least in part to stabilize organic radicals generated by the cracking of coal molecules. Agitation of the reactor contents is normally not necessary.

The effluent from first stage liquefaction reactor 16, which contains gaseous liquefaction products such as carbon monoxide, carbon dioxide, ammonia, hydrogen, hydrogen sulfide, methane, ethane, ethylene, propane, propylene and the like, unreacted hydrogen from the feed slurry, light liquids, and heavier liquefaction products including mineral matter, unconverted coal solids and high molecular weight liquids is withdrawn from the top of the reactor through line 17, preheated and passed to second stage liquefaction reactor 18. Here the effluent is subjected to further liquefaction at a temperature greater than the temperature in liquefaction reactor 16, normally at a temperature above about 760° F. and preferably at a temperature between about 800° F. and 880° F. The pressure in the reactor will normally range between about 300 psig and about 4500 psig, preferably between about 1000 psig and about 2500 psig. Although a single liquefaction reactor is shown in the drawing as comprising the second liquefaction stage, a plurality of reactors arranged in parallel or series can also be used providing that the temperature and pressure in each reactor remain about equal. Such will be the case if it is desirable to approximate a plug flow situation. The slurry residence time within second stage reactor 18 will normally range between about 15 minutes and about 100 minutes and will preferably be between about 30 minutes and about 60 minutes.

The reactions taking place in the liquefaction zone in second stage reactor 18 are similar to those that occur in first stage liquefaction reactor 16. The unconverted coal and high molecular weight constituents are broken down and hydrogenated to form lower molecular weight gases and liquids. The hydrogen-donor solvent gives up hydrogen atoms that react with organic radicals formed when the unconverted coal and high molecular weight constituents are cracked, thereby preventing their recombination. Molecular hydrogen in the gas phase also serves at least in part to stabilize organic radicals generated by the cracking of the coal and other high molecular weight constituents. Normally, sufficient hydrogen is injected into line 14 via line 15 so that sufficient hydrogen is present in the vapor phase in reactor 18 to help stabilize coal radicals. If necessary, additional hydrogen may be injected directly into reactor 18. Also, if it becomes desirable to omit hydrogen from first stage reactor 16, the hydrogen in line 15 may be diverted from line 14 into line 17.

In conventional coal liquefaction operations, one liquefaction zone operated at a temperature above 750° F. is normally utilized. Such a single stage liquefaction will normally convert only a portion of the coal feed into lower molecular weight liquids. The liquid effluent from such a zone may contain up to 50 or more weight percent of unconverted coal and other high molecular weight hydrocarbons based on the weight of the coal feed to the reactor. Studies indicate that a significant increase in the production of low molecular weight liquids cannot be obtained in a single liquefaction zone. Failure to convert more of the coal into lower molecular weight liquids makes a single stage, constant temperature hydrogen-donor liquefaction process somewhat inefficient and uneconomical. It is desirable to obtain as high a conversion of coal into lower molecular weight liquids as possible without substantially increasing hydrogen consumption and gas make.

It has been found that increased coal conversion in a liquefaction process can be obtained by subjecting the coal to hydrogen-donor liquefaction in a plurality of liquefaction zones arranged in series and operated such that the temperature in each zone increases from the initial to the final zone in the series. The effluent from each liquefaction zone excluding the final zone is passed to the next succeeding zone of higher temperature. In this manner the feed solids that are not liquified or converted to lower molecular weight liquids in the initial zone are at least partially liquified in the second zone; the unconverted solids in the effluent from the second zone are at least partially liquified in the third zone and so forth until the final zone is reached. Here the remaining unconverted solids are subjected to liquefaction at normal liquefaction temperatures, temperatures above about 760° F., to convert them into lower molecular weight liquids. This process of staged temperature hydrogen-donor liquefaction is much more effective in obtaining further conversion of unconverted coal constituents into liquids without substantially increasing gas make or hydrogen consumption than is a single stage liquefaction at a constant temperature. The process is effective in obtaining increased production of liquids even without the presence of an added hydrogenation or hydrogen transfer catalyst in one or more of the liquefaction zones. As many liquefaction zones as desired may be used to increase the overall conversion of the coal into lower molecular weight liquids, but it appears that two zones may be the economic optimum.

The above described process is based in part on the discovery that a substantial increase in the production of low molecular liquids can be obtained by subjecting the coal-solvent slurry to liquefaction in a liquefaction zone or series of such zones at relatively low temperatures and long residence times prior to subjecting the slurry to high temperature liquefaction. Normally such a low temperature, long residence time liquefaction step is carried out at a temperature between about 670° F. and about 740° F. and at a residence time above about 65 minutes. Under such conditions a substantial number of high molecular weight coal constituents are broken down and hydrogenated to form lower molecular weight liquids thus resulting in at least partial liquefaction of the coal. In the preferred embodiment of the process of the invention as depicted in the drawing, the low temperature, long residence time liquefaction step is carried out in a single stage liquefaction zone represented by reactor 16 prior to high temperature, short residence time liquefaction in a second stage liquefaction zone represented by reactor 18.

It is not presently understood why increased amounts of low molecular liquids are produced in the process of the invention. It is theorized, however, that the increase in coal conversion is due to more effective stabilization of coal fragments or radicals by the staged temperature liquefaction. Coal consists of chemical bonds with various strengths. A low temperature will break weaker bonds; whereas a high temperature will break stronger bonds. If the coal-solvent slurry is immediately subjected to a high temperature, the weaker bonds will break too rapidly, thereby producing an overabundance of coal fragments at one time. Many of these fragments may not be stabilized in time by hydrogen and may recombine to form high molecular weight constituents. By liquifying the coal in a series of low temperature zones each operated at a higher temperature than the preceding zone, only a small portion of the bonds, the weaker bonds, are broken at a time. This in turn results in a more efficient stabilization of coal radicals thereby minimizing their recombination and producing a higher yield of low molecular weight liquids.

Referring again to the drawing, the effluent from second stage liquefaction reactor 18 is withdrawn from the top of the reactor through line 19 and passed to separator 20. Here the reactor effluent is separated; preferably at substantially liquefaction pressure into an overhead vapor stream that is withdrawn through line 21 and a liquid stream removed through line 22. The overhead vapor stream is passed to downstream units where the ammonia, hydrogen and acid gases are separated from the low molecular weight gaseous hydrocarbons, which are recovered as valuable byproducts. Some of these light hydrocarbons, such as methane and ethane, may be steam reformed to produce hydrogen that can be recycled where needed in the process.

The liquid stream removed from separator 20 through line 22 will normally contain low molecular weight liquids, high molecular weight liquids, mineral matter and unreacted coal. This stream is passed through line 22 into atmospheric distillation column 23 where the separation of low molecular weight liquids from the high molecular weight liquids boiling above about 1000° F. and solids is begun. In the atmospheric distillation column the feed is fractionated and an overhead fraction composed primarily of gases and naphtha constituents boiling up to about 400° F. is withdrawn through line 24, cooled and passed to distillate drum 25 where the gases are taken off overhead through line 26. This gas stream may be employed as a fuel gas for generation of process heat, steam reformed to produce hydrogen that may be recycled to the process where needed, or used for other purposes. Liquids are withdrawn from distillate drum 25 through line 27 and a portion of the liquids may be returned as reflux through line 28 to the upper portion of the distillation column. The remaining naphtha can be recovered as product or may be passed through lines 27 and 29 into line 41 and used as feed for the solvent hydrogenation unit, which is described in detail hereafter.

One or more intermediate fractions boiling within the range of about 250° F. and about 700° F. is withdrawn from distillation column 23 for use as feed to the solvent hydrogenation unit. It is generally preferred to withdraw a relatively light fraction composed primarily of constituents boiling below about 500° F. through line 30 and to withdraw a heavier intermediate fraction composed primarily of constituents boiling below about 700° F. through line 31. These two distillate fractions are passed through line 29 into line 41 for use as liquid feed to the solvent hydrogenation unit. The bottoms from the distillation column, composed primarily of constituents boiling in excess of 700° F. is withdrawn through line 32, heated to a temperature between about 600° F. and 775° F., and introduced into vacuum distillation column 33.

In the vacuum distillation column the feed is distilled under reduced pressure to permit the recovery of an overhead fraction that is withdrawn through line 34, cooled and passed into distillate drum 35. Gases are removed from the distillate drum via line 36 and may either be used as fuel, passed to a steam reformer to produce hydrogen for recycling to the process where needed, or used for other purposes. Light liquids are withdrawn from the distillate drum through line 37. A heavier intermediate fraction, composed primarily of constituents boiling below about 850° F., may be withdrawn from the vacuum distillation tower through line 38 and a still heavier side stream may be withdrawn through line 39. These three distillate fractions are passed through line 40 into line 41 for use as feed to the solvent hydrogenation unit. The bottoms from the vacuum distillation column, which consists primarily of high molecular weight liquids boiling above 1000° F., mineral matter and unreacted coal, are withdrawn through line 42 and may be used as a fuel; passed to downstream units to undergo coking, pyrolysis, gasification or some similar conversion process; or utilized for some other purpose.

The liquid feed available for solvent hydrogenation includes, as pointed out above, liquid hydrocarbons composed primarily of constituents boiling in the 250° F. to 700° F. range recovered from atmospheric distillation column 23 through line 29 and heavier hydrocarbons in the 700° F. to 1000° F. boiling range recovered from vacuum distillation column 33 through line 40. These hydrogenation reactor feed components, which are combined in line 41, are heated to solvent hydrogenation temperature, mixed with hydrogen injected into line 41 through line 44 and introduced into the hydrogenation reactor. The particular reactor shown in the drawing is a two-stage downflow unit including an initial stage 45 connected by line 46 to a second stage 47, but other types of reactors can be used if desired.

The solvent hydrogenation reactor is preferably operated at about the same pressure as that in liquefaction reactor 18 and at a somewhat lower temperature than in the liquefaction reactor. The temperature, pressure and space velocity employed in the reactor will depend to some extent upon the character of the feed stream employed, the solvent used and the hydrogenation catalyst selected for the process. In general, temperatures within the range between about 550° F. and about 850° F., pressures between about 800 psig and 3000 psig, and space velocities between about 0.3 and 3.0 pounds of feed/hour/pound of catalyst are suitable. Hydrogen treat rates within the range between about 500 and 12,000 standard cubic feet per barrel of feed may be used. It is generally preferred to maintain a mean hydrogenation temperature within the reactor between about 620° F. and 750° F., a pressure between about 1200 and 2500 psig, a liquid hourly space velocity between about 1.0 and 2.5 pounds of feed/hour/pound of catalyst and a hydrogen treat rate within the range of about 500 and 4000 standard cubic feet per barrel of feed.

Any of a variety of conventional hydrotreating catalysts may be employed in the process. Such catalysts typically comprise an alumina or silica-alumina support carrying one or more iron group metals and one or more metals from Group VI-B of the Periodic Table in the form of an oxide or sulfide. Combinations of one or more Group VI-B metal oxide or sulfide with one or more Group VIII metal oxide or sulfide are generally preferred. Representative metal combinations which may be employed in such catalysts include oxides and sulfides of cobalt-molybdenum, nickel-molybdenum-tungsten, cobalt-nickel-molybdenum, nickel-molybdenum, and the like. A suitable catalyst, for example, is a high metal content sulfided cobalt-molybdenum-alumina catalyst containing about 1–10 weight percent of cobalt oxide and about 5–40 weight percent of molybdenum oxide, perferably from 2–5 weight percent of the cobalt oxide and from about 10–30 weight percent of the molybdenum oxide. Other metal oxides and sulfides in addition to those specifically referred to above, particularly the oxides of iron, nickel, chromium, tungsten and the like, can also be employed. The preparation of such catalysts has been described in the literature and is well known in the art. Generally, the active metals are added to the relatively inert carrier by impregnation from an aqueous solution and this is followed by drying and calcining to activate the catalyst. Numerous commercial hydrogenation catalysts are available from various catalyst manufacturers and can be used.

The hydrogenated effluent from the second stage 47 of the reactor is withdrawn through line 48 and passed into separator 49 from which an overhead stream containing hydrogen gas is withdrawn through line 50. This gas stream is at least partially recycled through line 50 for reinjection with the feed slurry into liquefaction reactor 16. Liquid hydrocarbons are withdrawn from the separator through line 51, preheated and passed to final fractionator 52. Here the preheated feed is distilled to produce an overhead product composed primarily of gases and naphtha boiling range hydrocarbons. This stream is taken off overhead through line 53, cooled and introduced into distillate drum 54. The off-gases withdrawn through line 55 will be composed primarily of hydrogen and normally gaseous hydrocarbons but will include some normally liquid constituents in the naphtha boiling range. This stream may be used as a fuel or employed for other purposes. The liquid stream withdrawn from drum 54 through line 56, composed primarily of naphtha boiling range materials, is in part recycled to the final fractionator as reflux through line 57 and in part recovered as product from line 58.

One or more side streams boiling above the naphtha boiling range are recovered from fractionator 52. In the particular unit shown in the drawing, a first side stream composed primarily of hydrocarbons boiling above about 700° is taken off through line 59. A second side stream composed primarily of hydrocarbons boiling below about 850° F. is withdrawn from the fractionator through line 60. A portion of each of these is recycled through lines 61 and 11 for use as hydrogen-donor solvent in the slurry preparation zone 12. A bottoms fraction composed primarily of hydrocarbons boiling below about 1000° F. is withdrawn from the fractionator through line 62 and passed into line 63. The liquids in lines 59 and 60 that are not recycled are passed respectively through lines 64 and 65 into line 63 where they are mixed with the bottoms stream from line 62 to form a liquid product which is withdrawn from the system through line 63.

The nature and objects of the invention are further illustrated by the results of laboratory and pilot plant tests. The first series of tests illustrates that coal is partially liquefied in a first liquefaction stage or zone operated at a relatively low temperature. The second series of tests illustrates that staged temperature liquefaction of a coal in two separate temperature zones result in an increased yield of liquid over liquefaction in a single zone operated at a constant temperature. The final series of tests illustrates that staged temperature liquefaction does not result in an increased conversion of the feed coal into liquids unless the first stage is operated at a relatively long residence time.

In the first series of tests, 40 grams of dried Illinois No. 6 coal and 64 grams of hydrogenated multipass spent solvent containing 1.51 weight percent donatable hydrogen were placed in a 300 cc autoclave. Sufficient hydrogen was then injected into the autoclave to produce a partial pressure of hydrogen equal to about 800 psig. The autoclave was heated to the desired temperature and maintained at that temperature for the desired residence time during which the autoclave was agitated at a rate of 1500 rpm. At the end of each run the autoclave was cooled to below a temperature of about 200° F. in a three minute period and then cooled slowly to room temperature. The slurry from the autoclave was transferred to a distillation flask and subjected to a glass spiral distillation to separate the liquids boiling below about 700° F. from the remainder of the slurry. The bottoms resulting from this distillation was then subjected to a microlube distillation to remove all liquids boiling below about 1000° F. The bottoms from the microlube distillation was washed for five minutes with toluene in an amount equal to ten times its weight. The mixture was then centrifuged for fifteen minutes at a speed of 2000 rpm. The upper layer which was rich in toluene was decanted and the remaining bottom layer was remixed with toluene and washed again as described above. This wash procedure was performed a total of five times. The amount of solid residue that did not dissolve in the toluene was measured. The amount of hydrogen-depleted solvent present in the slurry was then subtracted from the total amount of 1000° F.− liquid recovered from the slurry to give the distillable liquid yield from the coal. The results of these tests are set forth in Table I below.

TABLE I

SINGLE STAGE HYDROGEN-DONOR LIQUEFACTION AT LOW TEMPERATURES

| | Run Number | | | | | |
|---|---|---|---|---|---|---|
| | 1 | 2 | 3 | 4 | 5 | 6 |
| Temperature, °F. | 690 | 690 | 690 | 730 | 730 | 730 |
| Residence Time (minutes) | 40 | 80 | 120 | 40 | 80 | 120 |
| $C_4$-1000° F. Liquid Yield (wt. % on dry coal) | 11.6 | 16.7 | 14.2 | 21.5 | 23.9 | 19.3 |
| 1000° F.+ (Bottoms) (wt % on dry coal) | 85.2 | 78.0 | 81.2 | 73.6 | 70.9 | 74.2 |
| Bottoms Soluble in Toluene (wt % on bottoms) | 4.3 | 4.5 | 7.1 | 3.7 | 4.3 | 6.7 |

As can be seen from Table I, the coal subjected to the single stage liquefaction at 690° F. and 730° F. respectively is at least partially converted into lower molecular weight liquids. The degree of conversion is dependent upon the residence time and tends to increase then decrease as residence time increases. The decrease in liquid yield for increasing residence time is not understood but is apparently due to a recombination of lower molecular weight constituents to form 1000° F.+ material. This theory is supported by the observed increase in the bottoms formed in runs 3 and 6. The additional bottoms formed was soluble in toluene which indicates that it will be easily converted to lower molecular weight liquids when subjected to liquefaction at higher temperatures.

In the second series of tests, Illinois No. 6 coal was treated in the manner described in the preceding series of tests except that after the autoclave was subjected to a low temperature heating step for a particular residence time, the temperature in the autoclave was inceased to 840° F. and maintained at that temperature for approximately 40 minutes to simulate staged temperature liquefaction. The autoclave was then cooled and the slurry effluent was subjected to a glass spiral distillation followed by a microlube distillation. Again, the distillable liquid yield was determined by subtracting the amount of hydrogen-depleted solvent present from the amount of liquids obtained by the two distillations. The results of these tests are set forth below in Table II.

TABLE II

STAGED TEMPERATURE HYDROGEN-DONOR LIQUEFACTION

| | Run Number | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| First Stage Temperature, (°F.) | — | — | — | — | — | 690 | 690 | 730 | 730 | 730 | 690 | 690 | 730 |
| First Stage Residence Time, (minutes) | — | — | — | — | — | 40 | 40 | 40 | 80 | 80 | 120 | 120 | 120 |

TABLE II-continued

STAGED TEMPERATURE HYDROGEN-DONOR LIQUEFACTION

| | Run Number | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| Second Stage Temperature, (°F.) | 840 | 840 | 840 | 840 | 840 | 840 | 840 | 840 | 840 | 840 | 840 | 840 | 840 |
| Second Stage Residence Time (minutes) | 40 | 40 | 40 | 40 | 40 | 40 | 40 | 40 | 40 | 40 | 40 | 40 | 40 |
| $C_4$1000° F. Liquid Yield (wt % on dry coal) | 26.6 | 28.4 | 28.6 | 27.1 | 27.5 | 27.7 | 31.0 | 29.9 | 33.1 | 30.7 | 36.4 | 35.7 | 33.5 |
| $C_4$-1000° F. Liquid Yield Average | | | 27.6 | | | 29.4 | | 29.9 | 31.9 | | 36.1 | | 33.5 |

The first five runs shown in Table II are for a single stage liquefaction carried out at a temperature of 840° F. and a residence time of 40 minutes. As can be seen from the Table, the average value of liquid yield for these high temperature, base case runs was 27.6 weight percent on dry feed coal. By comparing the average liquid yield from staged temperature hydrogen-donor liquefaction runs 6 through 8 in which the low temperature first liquefaction zone or stage was operated at a residence time of 40 minutes with the average liquid yield from the high temperature, single liquefaction zone runs 1 through 5, it can be seen that a short residence time in the low temperature zone results in only a small increase in liquid yield. Runs 9 through 13, however, indicate that as the residence time in the low temperature zone increases, the liquid yield from staged temperature liquefaction also increases. The highest liquid yield was obtained when the first stage or zone was operated at 690° F. and at a residence time of 120 minutes. The data for runs 11 through 13 in which the first stage liquefaction was carried out at the same residence time tend to indicate that the liquid yield decreases as the temperature in the first stage increases. In summary, the data in Table II tend to indicate that both temperature and residence time in the first stage are important in obtaining a maximum liquid yield from a staged temperature hydrogen-donor liquefaction process.

The third series of tests was conducted in the pilot plant and further illustrates that staged temperature hydrogen-donor liquefaction results in significant increases of liquid yields only when the first stage is operated at a relatively long residence time. Illinois No. 6 coal was slurried with a coal-derived hydrogen-donor solvent boiling between about 400° F. and 700° F. in a solvent-to-coal weight ratio of 1.6:1 and the resultant slurry was fed to a first liquefaction reactor which was part of a coal liquefaction pilot plant somewhat similar to that depicted in the drawing. Before the slurry was fed into the first liquefaction reactor it was mixed with 4.0 weight percent molecular hydrogen based on the weight of the feed coal. The first reactor was operated at temperatures of 680° F., 700° F. and 730° F. The residence time in the first stage for two of the four two-stage runs was 25 minutes. The residence time for the first stage in the other two runs was 120 minutes. The effluent from the first liquefaction reactor was then passed into a second liquefaction reactor operated at relatively high temperatures. For comparison purposes, single stage liquefaction runs were carried out in the second liquefaction stage of the pilot plant at temperatures of 840° F. and 880° F. and residence times of 15 and 40 minutes. The results of these tests are set forth below in Table III.

TABLE III

STAGED TEMPERATURE HYDROGEN-DONOR LIQUEFACTION IN A PILOT PLANT

| | Run Number | | | | | |
|---|---|---|---|---|---|---|
| | 1 | 2 | 3 | 4 | 5 | 6 |
| First Stage Temp., (°F.) | 700 | 680 | — | 700 | 730 | — |
| First Stage Residence Time, (minutes) | 25 | 25 | — | 120 | 120 | — |
| Second Stage Temp., (°F.) | 880 | 880 | 880 | 840 | 840 | 840 |
| Second Stage Residence Time, (minutes) | 15 | 15 | 15 | 40 | 40 | 40 |
| $C_4$-1000° F. Liquid Yield (wt. % on dry coal) | 30 | 33 | 31 | 40 | 37 | 34 |

It can be seen from runs 1, through 3 listed in Table III that staged temperature liquefaction with the first stage operated at temperatures of 680° F. and 700° F. and a residence time of 25 minutes produces only a small increase in liquid yield over single stage liquefaction. Runs 4 through 6 indicate, however, that significant increases in liquid yield are obtained when the first stage is operated at a residence time of 120 minutes. Thus, it again appears that staged temperature hydrogen-donor liquefaction is effective only when the first stage is operated at a relatively long residence time.

It will be apparent from the preceding discussion that the invention provides an improved process for converting coal into a hydrogenated liquid product. The process results in an increased yield of hydrogenated liquid product with a resultant decrease in the amount of high molecular weight bottoms produced.

We claim:

1. A hydrogen-donor liquefaction process for converting coal or similar liquefiable carbonaceous solids into lower molecular weight liquid hydrocarbons which comprises:

(a) contacting said carbonaceous solids with a hydrogen-donor solvent in the absence of an added hydrogenation catalyst under liquefaction conditions in a plurality of liquefaction zones arranged in series and operated such that (1) the temperature in each zone increases from the initial to the final zone of the series, (2) substantially all of the liquids, unconverted carbonaceous solids and mineral matter exiting each zone is passed to the next succeeding zone and (3) the total residence time for all of said zones combined excluding the final zone is greater than the residence time in said final zone, wherein said carbonaceous solids are partially converted into lower molecular weight liquid hydrocarbons in each of said liquefaction zones and said initial zone is operated at a temperature of at least 670° F.; and (b) recovering liquid hydrocarbonaceous products from the effluent of said final liquefaction zone.

2. A process as defined in claim 1 wherein the total residence time for all of said liquefaction zones combined excluding said final zone is above about 65 minutes.

3. A process as defined in claim 2 wherein the total residence time for all of said liquefaction zones combined excluding said final zone is between about 85 and about 150 minutes.

4. A process as defined in claim 1 wherein said initial liquefaction zone is operated at a temperature between about 670° F. and about 740° F.

5. A hydrogen-donor liquefaction process for converting coal or similar liquefiable carbonaceous solids into lower molecular weight liquid hydrocarbons which comprises:

(a) contacting said carbonaceous solids with a hydrogen-donor solvent in the absence of an added hydrogenation catalyst under liquefaction conditions in a plurality of liquefaction zones arranged in series and operated such that (1) the temperature in each zone increases from the initial to the final zone, (2) substantially all of the liquids, unconverted carbonaceous solids and mineral matter exiting each zone is passed to the next succeeding zone and (3) the total residence time in all of said zones combined excluding the final zone is above about 65 minutes and is greater than the residence time in said final zone, wherein said carbonaceous solids are partially converted into lower molecular weight liquid hydrocarbons in each of said liquefaction zones and said initial zone is operated at a temperature between about 670° F. and about 740° F.;

(b) separating the effluent from said final liquefaction zone into a vaporous fraction and a liquid fraction;

(c) recovering a liquid hydrocarbon stream containing hydrogen-donor solvent constituents from said liquid fraction;

(d) contacting said liquid hydrocarbon stream with hydrogen in a catalytic solvent hydrogenation zone maintained under solvent hydrogenation conditions;

(e) recovering a hydrogenated effluent from said solvent hydrogenation zone;

(f) separating said hydrogenated effluent into a gaseous stream and a liquid stream; and (g) recycling at least a portion of said liquid stream as hydrogen-donor solvent to said initial liquefaction zone.

6. A process as defined in claim 5 wherein said carbonaceous solids and said hydrogen-donor solvent are contacted in a series of two liquefaction zones.

7. A process as defined in claim 5 wherein said initial liquefaction zone is operated at a temperature in the range between about 690° F. and about 730° F. and said final liquefaction zone is operated at a temperature in the range between about 800° F. and about 880° F.

8. A hydrogen-donor liquefaction process for converting coal or similar liquefiable carbonaceous solids into lower molecular weight liquid hydrocarbons which comprises:

(a) contacting said carbonaceous solids with a hydrogen-donor solvent and molecular hydrogen in the absence of an added hydrogenation catalyst under liquefaction conditions in a first liquefaction zone maintained at a temperature of at least 670° F. to at least partially convert said solids into lower molecular weight liquid hydrocarbons thereby producing a liquefaction effluent containing liquids, unconverted carbonaceous solids and mineral matter;

(b) subjecting substantially all of said liquids, unconverted carbonaceous solids and mineral matter in said liquefaction effluent from said first liquefaction zone to liquefaction conditions in the absence of an added hydrogenation catalyst and in the presence of molecular hydrogen in a second liquefaction zone maintained at a temperature greater than the temperature in said first liquefaction zone, thereby further converting said carbonaceous solids into lower molecular weight liquid hydrocarbons and wherein the residence time in said first liquefaction zone is greater than the residence time in said second liquefaction zone; and (c) recovering liquid hydrocarbonaceous products from the effluent of said second liquefaction zone.

9. A process as defined in claim 8 wherein the residence time in said first liquefaction zone is sufficient to produce an increase in liquid yield over a single stage liquefaction carried out under the conditions in said second liquefaction zone.

10. A process as defined in claim 8 wherein sufficient liquefaction occurs in said first zone to produce at least 10 weight percent of liquids boiling below 1000° F., based on the dry feed solids.

11. A hydrogen-donor liquefaction process for converting coal or similar liquefiable carbonaceous solids into lower molecular weight liquid hydrocarbons which comprises:

(a) contacting said carbonaceous solids with a hydrogen-donor solvent and molecular hydrogen in the absence of an added hydrogenation catalyst under liquefaction conditions in a first liquefaction zone maintained at a temperature between about 670° F. and about 740° F. and having a residence time greater than about 65 minutes to at least partially convert said carbonaceous solids into lower molecular weight liquid hydrocarbons thereby producing a liquefaction effluent containing liquids, unconverted carbonaceous solids and mineral matter;

(b) subjecting substantially all of said liquids, unconverted carbonaceous solids and mineral matter in said liquefaction effluent from said first liquefaction zone to liquefaction conditions in the absence of an added hydrogenation catalyst and in the presence of molecular hydrogen in a second liquefaction zone maintained at a temperature in the range between about 800° F. and about 880° F., thereby further converting said carbonaceous solids into lower molecular weight liquid hydrocarbons and wherein the residence time in said first liquefaction zone is greater than the residence time in said second liquefaction zone;

(c) separating the effluent from said second liquefaction zone into a vaporous fraction and a liquid fraction;

(d) recovering a liquid hydrocarbon stream containing hydrogen-donor solvent constituents from said liquid fraction;

(e) contacting said liquid hydrocarbon stream with hydrogen in a catalytic solvent hydrogenation zone maintained under solvent hydrogenation conditions;

(f) recovering a hydrogenated effluent from said solvent hydrogenation zone;

(g) separating said hydrogenated effluent into a gaseous stream and a liquid stream; and (h) recycling at least a portion of said liquid stream as hydrogen-donor solvent to said first liquefaction zone.

12. A process as defined in claim 1 comprising the further steps of:

(c) recovering a liquid hydrocarbon stream containing hydrogen-donor solvent constituents from the effluent of said final liquefaction zone;

(d) contacting said liquid hydrocarbon stream with hydrogen in a catalytic solvent hydrogenation zone external to said liquefaction zones and maintained under solvent hydrogenation conditions;

(e) recovering a hydrogenated effluent from said catalytic solvent hydrogenation zone;

(f) separating said hydrogenated effluent into a gaseous stream and a liquid stream; and (g) recycling at least a portion of said liquid stream as hydrogen-donor solvent to said initial liquefaction zone.

* * * * *